United States Patent [19]

Watanabe

[11] Patent Number: 4,684,272

[45] Date of Patent: Aug. 4, 1987

[54] SPOOL FOR CORRECTION TAPE ASSEMBLY

[75] Inventor: Hiroaki Watanabe, Yokohama, Japan

[73] Assignee: Fuji Kagakushi Kogyo Co., Ltd., Osaka, Japan

[21] Appl. No.: 811,157

[22] Filed: Dec. 19, 1985

[30] Foreign Application Priority Data

Dec. 19, 1984 [JP] Japan ..... 59-193634[U]

[51] Int. Cl.[4] ..... B65H 75/00; B65H 75/18

[52] U.S. Cl. ..... 400/242; 400/240.1; 242/71.8

[58] Field of Search ..... 400/240.1, 242, 244; 242/71.8, 118.61, 118.62

[56] References Cited

U.S. PATENT DOCUMENTS

| | | | |
|---|---|---|---|
| 2,086,948 | 7/1937 | Schwartz et al. | 242/118.62 |
| 2,626,113 | 1/1953 | Miller | 242/118.62 |
| 3,211,273 | 10/1965 | Bishop | 400/242 X |
| 3,940,087 | 2/1976 | Portal | 242/118.62 |
| 4,203,676 | 5/1980 | Hatsell | 400/242 X |
| 4,423,974 | 1/1984 | Müller et al. | 400/242 |
| 4,452,404 | 6/1984 | Gelardi et al. | 242/71.8 |
| 4,518,128 | 5/1985 | Watanabe | 242/71.8 |
| 4,523,727 | 6/1985 | Morioka | 242/71.8 X |
| 4,564,156 | 1/1986 | Cybulski | 242/71.8 X |

OTHER PUBLICATIONS

IBM Tech. Disc. Bulletin, "Quick Mount and Remove Tape Reel Latch", Froelich, vol. 6, No. 4, Sep. 1983, pp. 83–84.

IBM Tech. Disc. Bulletin, "Self-Locking Support for Ribbon Spool", Matthaei, vol. 20, No. 8, Jan. 1978, pp. 3177–3178.

*Primary Examiner*—Edgar S. Burr
*Assistant Examiner*—James P. McDaniel
*Attorney, Agent, or Firm*—Thomas L. Tully

[57] ABSTRACT

A spool for a reversible-type correction tape assembly, in which an improved fastening means is provided between the cap and the spool shaft. The spool shaft is designed to hold a ribbon-winding core so that the winding core is slideable in an axial direction of the spool shaft but is not rotatable relative to the shaft. The cap is detachably mounted on the top portion of the spool shaft so that the winding core does not slip off of the spool shaft. The spool shaft is provided with a male thread on a peripheral portion which is an extension above the winding core when the latter is engaged on the spool shaft. The cap is provided with a cylindrical bore having a seat portion and an inner peripheral surface provided with a female thread capable of engaging the male thread of the shaft, and the spool shaft has a transverse projection on the head surface thereof designed to press into the seat portion of the cap when the cap is screwed onto the shaft extension, to provide an improved fastening means, the material of the seat portion being softer than the material of the projection. The cap can be easily detached and can be securely fastened against loosening during use.

6 Claims, 6 Drawing Figures

SPOOL FOR CORRECTION TAPE ASSEMBLY

BACKGROUND OF THE INVENTION

The present invention relates to a spool for a correction tape assembly. More particularly, it relates to a spool adapted to be used in a winding side of a correction tape assembly which can be used one or more times (hereinafter, referred to as a spool for reversible-type correction tape assembly).

Generally, a correction tape for a typewriter will have ink stuck to its lift-off surface only once, after which it is considered to be no longer suitable for further use. Therefore, a conventional correction tape assembly has been designed in a suitable structure for only one use. For example, such a correction tape assembly includes a dispensing core to be set onto a dispensing mechanism of a typewriter, a correction tape hving an end which is fixed to the dispensing core and being wound around the dispensing core, and a spool onto which the free end of the correction tape is fixed. The used portion of the correction tape is wound around the spool which is set onto a winding mechanism of the typewriter.

However, it was recently found that those correction tapes can be used several times, and therefore, a reversible-type correction tape assembly is proposed in order for enabling re-use of the correction tape without change of the construction of conventional typewriters. For example, my U.S. Pat. No. 4,518,128 discloses a reversible-type correction tape assembly comprising a correction tape; a dispensing core; a winding core which has the same shape and size as the dispensing core; a spool shaft capable of holding the winding core so that the winding core is not rotatable around the spool shaft and is slidable in the axial direction; and a cap detachably mounted to the top portion of the spool shaft for preventing slip-out of the winding core.

In the above-mentioned reversible-type correction tape assembly, the spool shaft and the cap as one of flanges have screw means capable of engaging with each other, and the cap is detachably fastened onto the top portion of the spool shaft by the screw means. Therefore, the two cores are interchangeable with each other, in order to remove the wound correction tape with the winding core from the winding mechanism and to re-set it on the dispensing mechanism of the typewriter.

However, in the above screw means, there is a disadvantage that the cap can loosen automatically and come off of the spool shaft when the correction tape is moved up in order to shift from an original lower position to an upper typing position, and as a result, the winding core can slip off of the spool shaft.

The present invention is directed to eliminate the above disadvantage in the above-mentioned spool of the reversible-type correction tape assembly.

The main object of the present invention is to provide a spool for a reversible-type correction tape assembly, in which the cap is securely fastened onto the top portion of the spool shaft, and further, the cap can be easily detached from the top portion of the spool shaft.

These and other object of the present invention will become apparent from the description hereinafter.

SUMMARY OF THE INVENTION

In accordance with the present invention, there is provided a spool for a correction tape assembly comprising:

a spool shaft adapted to hold a winding core so that the winding core is slidable in an axial direction of the spool shaft, but is not relatively rotatable around the axis of the spool shaft; and a cap detachably mounted on a top portion of the spool shaft so that the winding core does not slip off of the spool shaft;

wherein the upper end of the spool shaft is provided with a male thread on a peripheral portion which is an extension above the winding core when the core is engaged with the spool shaft;

the cap is provided with a cylindrical bore having a bottom and an inner peripheral surface on which a female thread capable of engaging with the male thread is formed; and the spool shaft has a projection on a head surface thereof, and material of the cap is softer than that of the spool shaft.

In this specification, the above-mentioned bottom of the bore means a portion capable of abutting with the projection on the head surface of the spool shaft. That is to say, the bottom can be partially opened or can be perfectly closed.

From the above construction, at the last turn when the cap is screwed onto the male thread portion, the projection of the spool shaft abuts to the bottom of the bore of the cap. Then, the inner bottom surface of the bore of the cap is resiliently deformed into a shape capable of engaging with the projection when the turn is continued, since the material of the cap is softer than that of the spool shaft. Further, the elastic force of restitution of the cap acts in the axial direction of the male thread portion.

As a result of the above function, the abutting force between engaging surface of the male thread portion and the cap increases, and therefore, a frictional resistance generates against their relative rotation, i.e. against looseness of the cap. Further, another resistance against their relative rotation generates, since the projection is held so as to engage with the inner bottom surface of the bore of the cap. From the above two multiplied effects, the cap and the spool shaft are not separated from each other by a vibration of the correction tape, for example, a vibration generates when the correction tape shifts upwardly or downwardly. Therefore, the above disadvantage of the conventional construction of the spool is eliminated.

Further, a required force for fastening the cap is weaker than the force required if the tightening of the cap is only obtained by an abutting force in the thread surfaces of the male thread portion and the cap. Therefore, the problem of loosening of the cap due to an inadequate fastening force is eliminated.

DETAILED DESCRIPTION OF THE INVENTION

Figure 1:
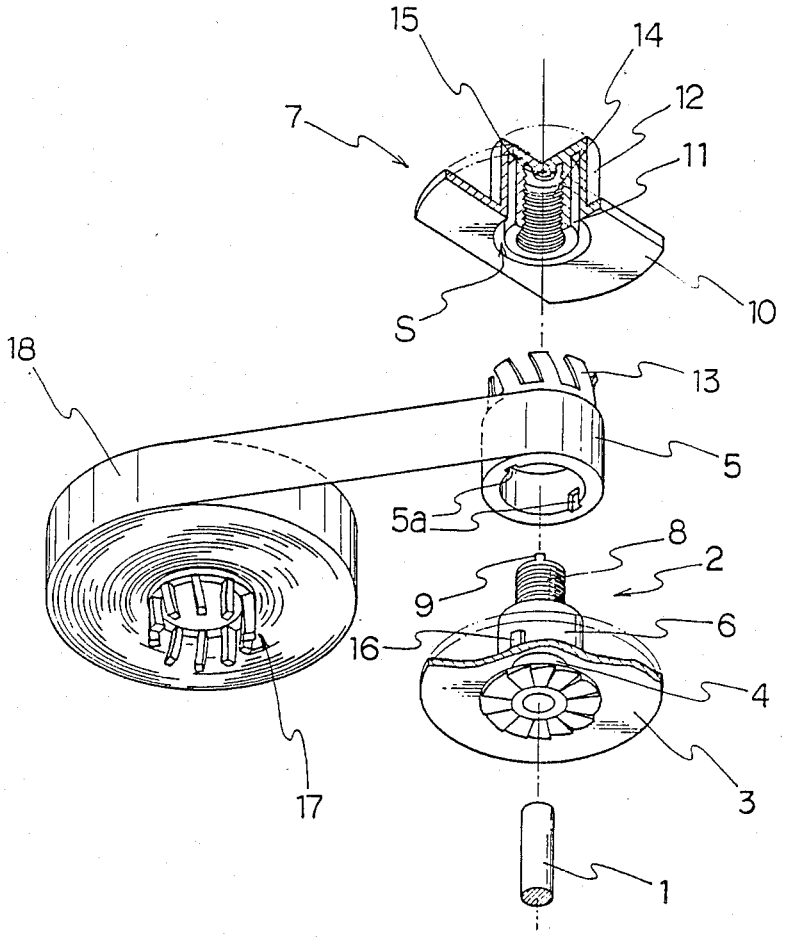
FIG. 1 is a partially cutaway and exploded perspective view showing an example of a reversible-type correction tape assembly including an embodiment of the spool of the present invention.
Figure 2:
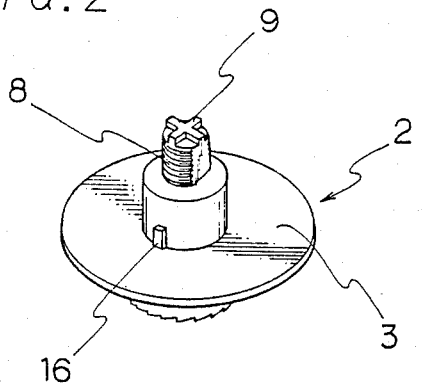
FIG. 2 is a perspective view showing an upper side of the spool shaft in FIG. 1.
Figure 3:
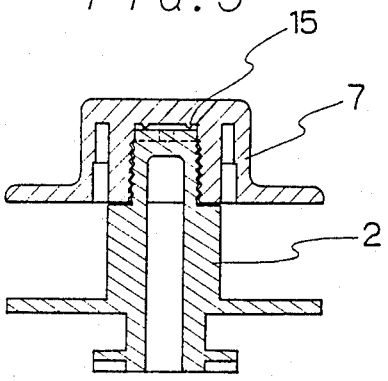
FIG. 3 is an longitudinal sectional view showing the spool in FIG. 1.

FIGS. 1 to 3 show the first embodiment of the spool of the present invention.

In FIG. 1, the numeral 1 denotes a known supporting shaft which is rotatably supported by a lift stage (not shown in FIG. 1) mounted on a carrier of a conventional typewriter.

The numeral 2 denotes a spool shaft which has a tubular form in order to be rotatably supported on the supporting shaft 1. A disk-like flange 3 is integrated at the middle portion in the axial direction of the spool shaft 2. The flange 3 causes the even winding of the correction tape 18 when the correction tape 18 is wound around a winding core 5.

The spool shaft 2 is provided with an annular groove 4 at a position under the flange 3. The annular groove 4 is to be engaged with a known stopper arm (not shown in FIGS. 1 to 3) which is attached to the above-mentioned lift stage.

Further, as shown in FIG. 2, at a portion over the flange 3, the spool shaft 2 is provided with a core-engaging portion 6 for engaging a core 5 so that the core 5 cannot rotate around the spool shaft 2. A male thread portion 8 capable of engaging with a cap 7 is integrated to an upper side portion of the spool shaft 2 which is situated above the core engaging portion 6. That is to say, the male thread portion is formed on a peripheral portion which is an extension when the winding core 5 is engaged with the spool shaft 2. The spool shaft 2 has a top surface from which a cross-shaped projection 9 extends.

The above-mentioned cap 7 has an integral, lower rectangle-shaped flange 10, and the inside of the cap 7 is formed into a double-pipe shape boss section for providing a cylindrical annular space S between an inner pipe portion 11 and an outer pipe portion 12. The space S is provided for receiving a set of helical claws 13 which are extending from an end of the core 5. The set of helical claws 13 has been known as a means for making a back-tension when a core is set as a dispensing core 17 to a dispensing mechanism of a typewriter. The inside space of the inner pipe portion 11 comprises a bore for receiving the male thread portion 8 of the spool shaft 2. The bore has a seat portion at the top surface and an inner peripheral surface. The inner peripheral surface is provided with a female thread portion 14 capable of engaging wih the male thread portion 8 of the spool shaft 2. Further, on the seat portion of the bore of the inner pipe portion 11, an annular projection 15 is provided in order that the seat portion of the bore can easily elastically deform when the cross-shaped projection 9 is pressed thereto.

The material of the spool shaft 2 and the material of the cap 7 are different in coefficient of elasticity. The material of the cap 7 is softer than that of the spool shaft 2. For example, when the spool shaft 2 is made of acrylonitrile-butadiene-styrene resin (ABS resin), the cap 7 can be made of, for example, polyethylene which is softer than ABS resin.

In such a spool constructed as mentioned above, by only screwing lightly the cap 7 onto the spool shaft 7, loosening of the cap 7 can be securely prevented since the cross-shaped projection 9 presses into the annular projection 15 of the seat portion of the cap 7.

In FIG. 1, the numeral 16 denotes a key-like projection to be inserted into a groove 5*a*. The groove 5*a* is provided in the inner surface of the core 5 and 17 in order to prevent the relative rotation between the core 5, 17 and the spool shaft 2.

When a new correction tape assembly is set to a typewriter, a new correction tape 18 is wound around the dispensing core 17. After the correction tape 18 is used once and wound around the winding core 5, the cores 5, 17 are inverted and exchanged with each other. In the case of the correction tape assembly shown in FIG. 1, the cores 5, 17 are turned up to down when they are exchanged. After the exchange, the used correction tape assembly can be further used as it is.

As described above, though a preferable embodiment of the spool of the invention has been explained, however it is to be understood that the spool of the invention is not limited to the extent of the above-described embodiment, but various modifications may be made in the invention without departing from the spirit and scope thereof. For example, several modifications explained hereinafter can be employed individually or in a combined state.

Figure 4:
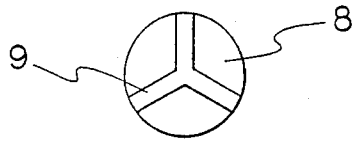
FIGS. 4 to 6 are partial plan views showing various embodiments of the projection in the present invention.
Figure 5:
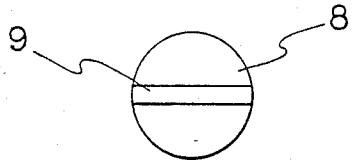
Figure 6:
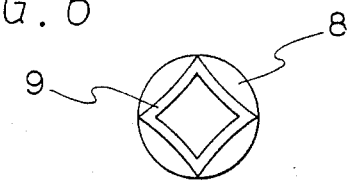

The shape of the projection 9 of the spool shaft 2 in the present invention is not limited to the cross-shaped type, but various shapes can be employed. For example, a tri-star-like projection 9 shown in FIG. 4, a straight projection 9 shown in FIG. 5, a square-box-shaped projection 9 shown in FIG. 6, and other suitable shape projections can be employed. The projections 9 are, for example, 1 to 2 mm in height and 1 to 2 mm in width.

Further, it is not necessary that different kinds of synthetic resins are used as the materials of the cap and the spool. For example, even if the same kind of synthetic resin is used, the extent of softness can be varied by selecting kinds or amounts of composed plasticizer.

Also, in the present invention, an annular projection 15 on the inner bottom surface of the cap 7 is not an essential element. However, when an annular projection 15 is formed, there is an advantage that the fastening force is reduced even if the material of the cap is relatively hard.

What is claimed is:

1. A typewriter spool designed to receive and releasably secure a correction tape-winding core for purposes of incrementally winding a length of correction tape on the core as portions of the tape are used for correction purposes, said spool comprising:

a spool shaft designed to receive a correction tape-winding core axially slideable thereon and relatively rotatable therewith, said shaft having a threaded upper portion which extends above the width of the correction tape being wound on said core, said upper portion having a head surface, and a cap having a threaded bore having a seat portion, said cap being threadably-engageable with the threaded upper portion of said spool shaft to secure a said correction tape core on said spool shaft against axial sliding movement, the head surface of said spool shaft and the seat portion of said cap bore being engaged when said cap is screwed onto said spool shaft, and said head surface and seat portion comprising materials having different coefficients of elasticity relative to each other so that one said material is a softer material and the other said material is a harder material relative thereto, the harder material thereof comprising a transverse, elongate projection which presses into the softer material thereof when said cap is tightened onto said spool shaft, causing relative compression and resistance to loosening of the cap from the shaft during use.

2. A typewriter spool according to claim 1 in which the head surface of said spool shaft comprises said transverse elongate projection of material which is harder than the material of the seat portion of said cap.

3. A typewriter spool according to claim 1 in which said spool shaft comprises a lower radially-extending flange which is designed to support a correction tape core when said core is slipped on to said shaft and to cause the even winding of correction tape on said core during use.

4. A typewriter spool according to claim 1 in which said cap comprises a lower radially-extending flange.

5. A typewriter spool according to claim 1 in which said spool shaft also comprises a key-like projection designed to mate with a recess in a correction tape core mounted thereon to prevent relative rotation between said spool shaft and said core.

6. An assembly comprising a typewriter spool according to claim 1 and a correction tape unit, said unit comprising a pair of identical correction tape cores united by a length of correction tape, each said core comprising a tape-winding core section and a plurality of annular helical claws projecting from said core section, one of said cores being a tape-dispensing core in normal position in which the claws thereof extend below the core section and are designed for engagement with the back tension mechanism of a typewriter, and the other of said cores being a tape-winding core in inverted position in which the claws thereof extend above the core section, and the cap of said typewriter spool has a double pipe boss section providing an outer annular space which receives the claws of the tape-winding spool when the cap is screwed onto the spool shaft.

* * * * *